US005389961A

United States Patent [19]

Takagi

[11] Patent Number: 5,389,961

[45] Date of Patent: Feb. 14, 1995

[54] INK JET PRINTER WITH VARIABLE-FORCE INK DECLOGGING APPARATUS

[75] Inventor: Seiichi Takagi, Suwa, Japan

[73] Assignee: Eastman Kodak Company, Rochester, N.Y.

[21] Appl. No.: 97,730

[22] Filed: Jul. 27, 1993

Related U.S. Application Data

[63] Continuation of Ser. No. 797,005, Nov. 25, 1991, abandoned.

[51] Int. Cl.[6] ..... B41J 2/165

[52] U.S. Cl. ..... 347/29; 347/47

[58] Field of Search ..... 346/1.1, 140 R; 347/29, 347/30, 32, 44, 47

[56] References Cited

U.S. PATENT DOCUMENTS

| | | | |
|---|---|---|---|
| 4,483,749 | 11/1984 | Shimamura | 204/15 |
| 4,577,203 | 3/1986 | Kawamura | 346/140 R |
| 4,587,535 | 5/1986 | Watanabe | 346/140 R |
| 4,600,931 | 7/1986 | Terasawa | 346/140 R |
| 4,620,202 | 10/1986 | Koto et al. | 346/140 R |
| 4,734,718 | 3/1988 | Iwagami et al. | 346/140 R |
| 4,806,955 | 2/1989 | Koto et al. | 346/140 R |
| 4,893,138 | 1/1990 | Terasawa et al. | 346/140 R |
| 5,055,856 | 10/1991 | Tomii et al. | 346/1.1 |

*Primary Examiner*—A. T. Grimley
*Assistant Examiner*—Thu Anh Dang
*Attorney, Agent, or Firm*—Milton S. Sales

[57] ABSTRACT

An ink jet printer includes apparatus for preventing ink clogs from interfering with the flow of ink from a printing nozzle during a printing operation. The ink-declogging apparatus includes a vacuum pump having a vacuum chamber and a member movable with respect to such chamber to adjust the pressure therein. A printing nozzle is operably coupled to the chamber when the printing nozzle is not being used in a print operation. A stepper motor controls the position of the movable member relative to the chamber to selectively provide at least two different preset levels of vacuum (suction) to the printing nozzle. Having the capability of controlling the level of vacuum applied to the printing nozzle, a high vacuum need only be applied in situations warranting its use (e.g. to remove ink clogs), and the waste of ink (by an unnecessarily high vacuum) can be avoided.

8 Claims, 3 Drawing Sheets

INK JET PRINTER WITH VARIABLE-FORCE INK DECLOGGING APPARATUS

This is a continuation of application Ser. No. 07/797,005, filed Nov. 25, 1991, now abandoned.

BACKGROUND OF THE INVENTION

The present invention relates to ink jet printers and, more particularly, to improvements in apparatus for preventing and/or eliminating ink clogs in the printing nozzles of such printers.

It is well known in the art to provide ink jet printers with mechanisms for preventing the formation of ink clogs in the printing nozzles of such printers. See, for example, the disclosures of U.S. Pat. Nos. 4,600,931 and 4,734,718. Referring to FIG. 3, conventional ink declogging mechanisms typically includes a pump 1 comprising a piston 3 slidably fitted in a cylinder 2, wherein positive and negative pressure is produced in a vacuum chamber 2A shown at the right side of the drawing. Inlet port 4 and discharge port 5 are formed at the closed end of the cylinder 2, such ports communicating with the vacuum chamber 2A. Inlet port 4 is connected through a tube 6 to a cap member 7 which covers the printhead nozzle when not in use. Discharge port 5 is connected through a tube 8 to the outside of the pump. Further, a first check valve (i.e., a one-way valve) 9 is provided in inlet port 4 for enabling ink fluid to move only in the direction from cap 7 to the interior of pump 1. Similarly, a second check valve 10 is provided in discharge port 5 for enabling fluid inside the pump housing to move only in a direction from inside the pump to the exterior of the pump.

A motor-driven gear 11 operates to rotate an eccentric cam 13 having a center which is concentric with a gear 12 which engages the motor-driven gear 11. One end of a crank shaft 14 is rotatably attached to an eccentric position of cam 13, and the other end of crank shaft 14 is rotatably attached to the piston 3 of pump 1. Thus, as cam 13 makes one revolution, piston 3 reciprocates once between positions c and b.

In the configuration described above, as motor gear 11 rotates in one direction, piston 3 moves from point c towards the left, as shown in the drawing. As a result, a negative pressure is produced in vacuum chamber 2A, as well as in cap member 7, which is fitted to the surface of the head nozzle. Thus, ink and bubbles inside the head nozzle are sucked out of the nozzle, through the first tube 6 and the first check valve 9 into vacuum chamber 2A to be temporarily stored therein. As gear 11 continues to rotate, piston 3 reaches the position marked "b" and then starts to move in the opposite direction. As a result of this movement, the pressure in vacuum chamber 2A increases, thereby causing the ink collected in vacuum chamber 2A to be discharged out of the system through an outlet tube 8. Thus, clogging up of the head nozzle is prevented by performing one or a few cycles of action as described above.

In declogging mechanisms of the type described above, the displacement distance of piston 3 is preset by the stroke of crank shaft 14. Consequently, the vacuum force applied to the nozzle is always constant. Using a constant vacuum force can be problematic in that if a relatively small force is chosen (e.g. a force which is sufficient, in a startup procedure, to draw a small amount of ink through the nozzles to assure that they are ready for printing), such force may be insufficient to remove ink clogs which have already formed in the nozzles. On the other hand, if the chosen force is sufficiently strong to remove already-formed ink clogs, it will suck an unnecessarily large volume of ink from the ink reservoir when no ink clogs are present, thereby wasting a substantial amount of ink. Also problematic with pumps of the above-described type is that any residual ink in the vacuum chamber 2A can dry out and impede the smooth movement of the pump piston in subsequent pumping operations.

SUMMARY OF THE INVENTION

In view of the foregoing, an object of this invention is to provide an ink jet printer with a clog prevention-/elimination mechanism which is capable of providing any one of a plurality of suction forces to the printhead, depending upon need.

Another object of this invention is to provide an ink-declogging apparatus in which dried residual ink in the vacuum chamber has little appreciable affect on the operation of the vacuum pump.

According to the invention, there is provided, in an ink jet printer, apparatus for preventing ink clogs from interfering with the flow of ink from a printing nozzle during a printing operation. The apparatus of the invention comprises a) a vacuum pump comprising means defining a vacuum chamber and a member movable with respect to said chamber-defining means to adjust the pressure within the chamber; b) means for selectively coupling a printing nozzle to the chamber when the printing nozzle is not being used in a print operation; and c) means for controlling the position of the movable member relative to the chamber-defining means to selectively provide at least two different preset levels of vacuum to the printing nozzle. Preferably, the vacuum chamber-defining means comprises a flexible bellows and the movable member is operatively coupled to the bellows to cause, during movement of such a member, the bellows to expand or contract, depending upon the direction of such movement, thereby decreasing or increasing, respectively, the pressure within the chamber. Also, preferred is that the control means comprises a stepper motor having a drive shaft operatively coupled to the movable member, the angular position of the shaft determining the position of the member.

The invention and its various objects and advantages will become more apparent to those skilled in the art from the ensuing detailed description of the preferred embodiment, reference being made to the accompanying drawings.

DETAILED DESCRIPTION OF PREFERRED EMBODIMENTS

Figure 1:
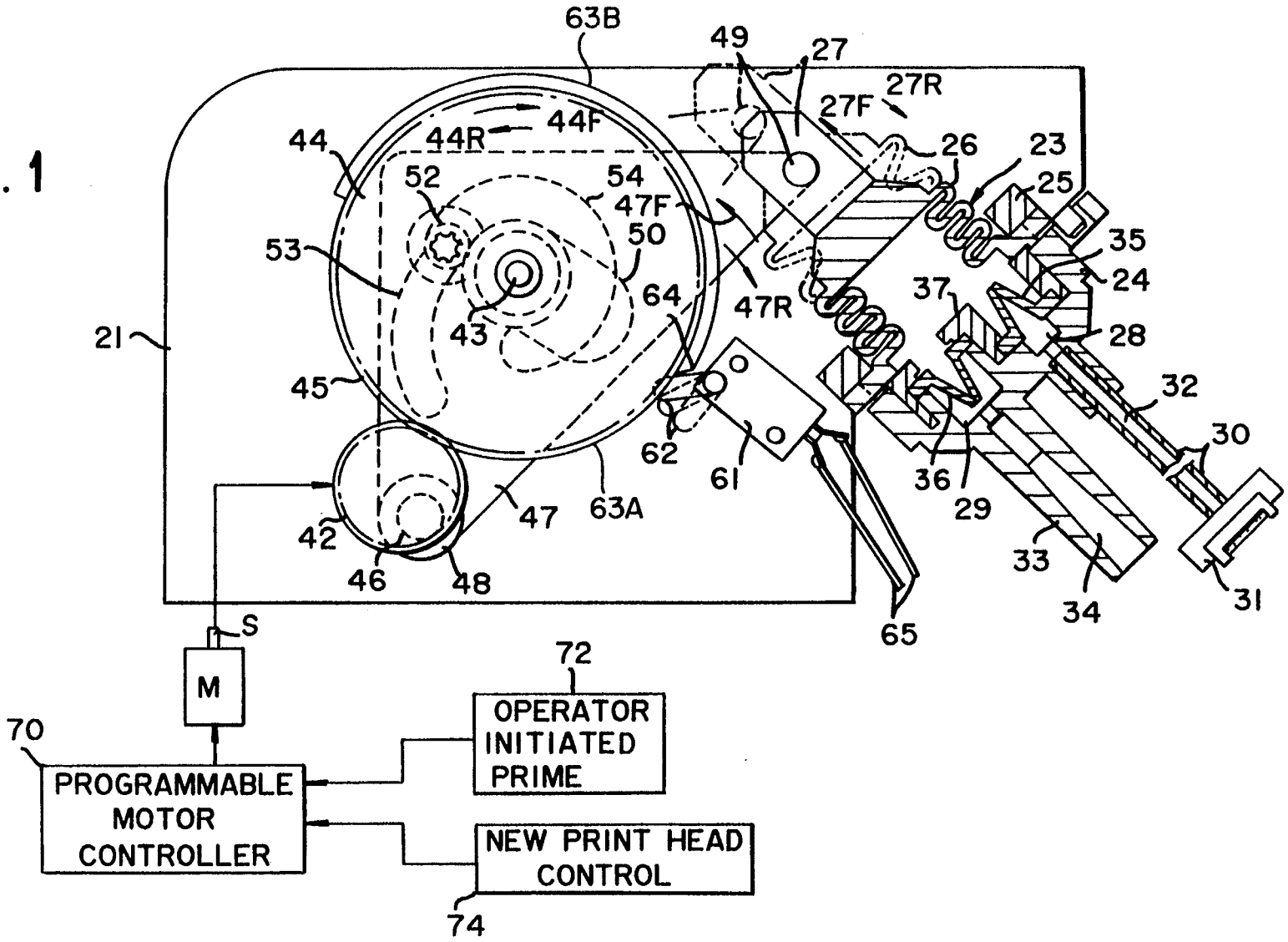
FIG. 1 is a bottom plan view of a preferred embodiment of the invention.
Figure 2:
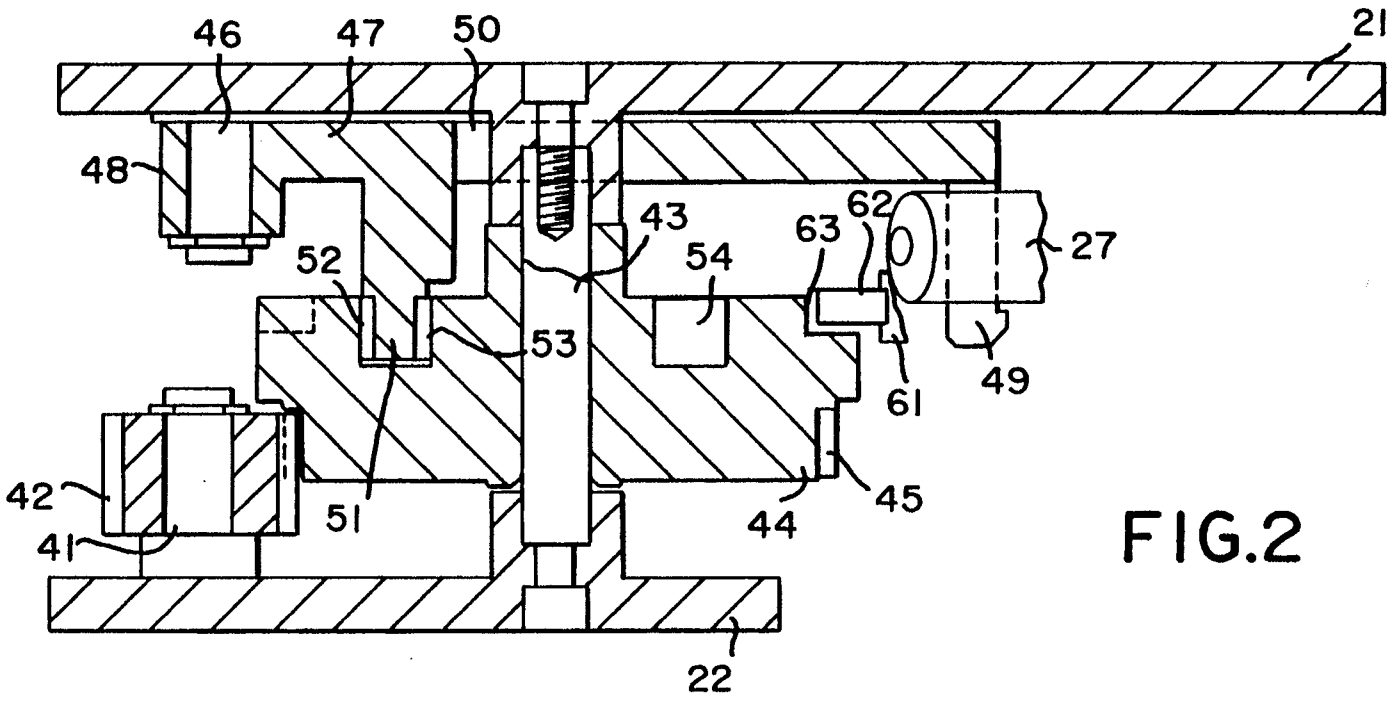
FIG. 2 is a cross-sectional illustration of the FIG. 1 apparatus.

A preferred embodiment of the present invention is explained hereunder with reference to FIGS. 1 and 2. The upper and lower directions referred to in the following explanation correspond to the upper and lower directions as they appear in FIG. 2.

Numerals 21 and 22 respectively denote upper and lower support plates which generally are parallel to each other. Mounted beneath upper support plate 21 is a suction pump 23 comprising a pump body 24, and a bellows comprising a stretchable and flexible membrane 26. An open end of the bellows is fastened by a fixture 25 to the pump body and the closed end is connected with a movable member 27. The pump is so configured as that linear reciprocating movement of member 27 acts to stretch or contract membrane 26, thereby causing pressure corresponding to the position of member 27 to be produced in pump body 24.

Pump body 24 is provided with an inlet port 28 and a discharge port 29 which are formed side by side. One end of a flexible tube 30 is connected to inlet port 28, and the other end is connected to cap member 31 which covers a printing nozzle (not shown) when not being used in a printing operation. Thus, the interiors of inlet port 28 and tube 30 form a first fluid passage 32 which connects the head nozzle to the interior of pump 23. A pair of check valves 35 and 36 are attached by fixture 37 to inlet port 28 and discharge port 29, respectively. Check valve 35 allows fluid to flow from the head nozzle into pump interior, but prevents flow in the opposite direction. On the other hand, check valve 36 allows fluid to flow from the interior of pump 23 to the outside, via a passage 34 defined by outlet tube 33, while preventing flow in the opposite direction.

Idler gear 42 is rotatably supported on a shaft 41 extending from bottom plate 22 so as to be rotatable both in the forward and reverse directions. The teeth of idler gear 42 are drivingly engaged by the teeth of a speed-reducing geartrain (not shown) which is driven by the drive shaft S of a conventional stepping motor M. The latter serves as the driving source of suction pump 23.

A cam shaft 43 is vertically supported between support plates 21 and 22 with both ends thereof being fastened to these plates. A cam member 44 is rotatably mounted on cam shaft 43 so as to be rotatable in both forward and reverse directions. The teeth of idle gear 42 are intermeshed with a gearing portion 45 of cam 44, such gearing portion being located on the lower part of cam 44, as better shown in FIG. 2. By this arrangement, cam 44 is rotatable in the forward and reverse directions by means of the driving power transmitted from the stepping motor.

A downwardly extending pin 46 located above idler gear 42, is fastened to the bottom of upper support plate 21. Pin 46 rotatably supports a bearing portion 48 formed at one end of a pump lever 47. Thus, pump lever 47 is able to rotate around the center axis of pin 46, along the lower surface of the upper first support plate 21. A shaft 49 projecting vertically downward from the opposite end of pump lever 47 is rotatably mounted on movable member 27. By this arrangement, rotational movement of the pump lever 47 produces a linear movement of member 27, the larger the rotation angle of pump lever 47, the greater the moving distance of member 27. Cam shaft 43 projects through an arc-shaped elongated hole 50 formed at the middle part of pump lever 47, the center of curvature of such arc being the center of rotation of pump lever 47. By this arrangement, cam shaft 43 does not hinder rotation of pump lever 47.

Figure 3:
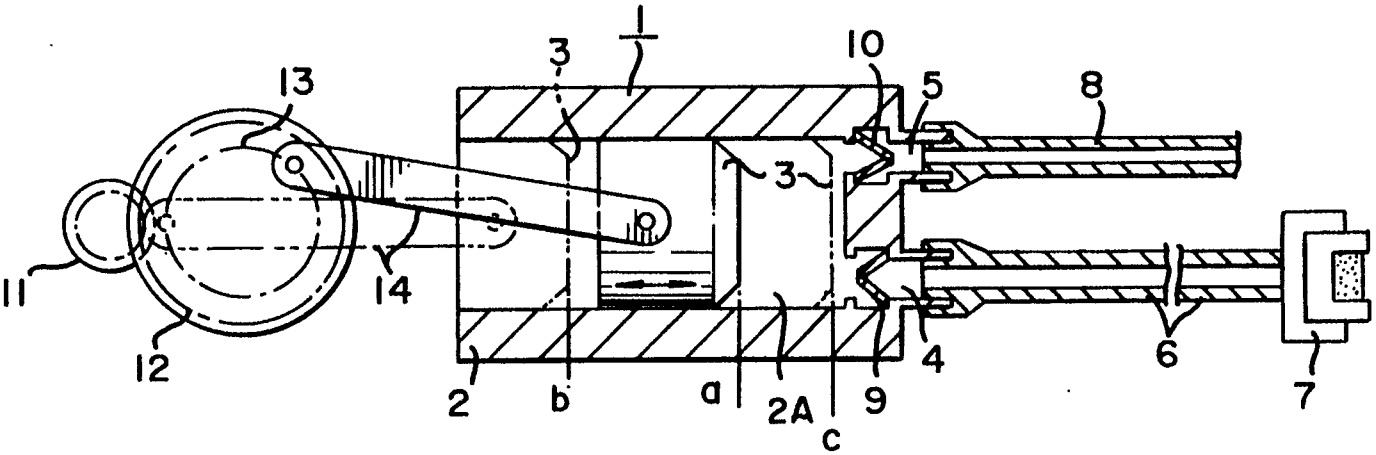
FIG.3 ( PRIOR ART )
FIG. 3 is a cross-sectional illustration of an ink jet declogging apparatus in accordance with the prior art.

To convert the rotation of movement of cam 44 to a rotational or pivotal movement of pump lever 47, a downwardly projecting shaft 51 is provided on the lower surface of the pump lever, between bearing portion 48 and connecting shaft 49. Shaft 51 supports a roller 52 which serves as a cam follower for a cam-shaped groove 53 formed in the upper surface of cam 44. Groove 53 has a spiral shape, starting from the vicinity of cam shaft 43 and gradually spiralling outward therefrom, in the counter-clockwise direction as it is shown in FIG. 3. An arc-shaped groove 54 which is also formed in the upper surface of cam 44, connects with that end of groove cam 53 proximate the end closer to cam shaft 43. The center of curvature of the arc-shaped groove is the axis of cam shaft 43. Roller 52 slidably engages groove cam 53. Thus, it may be appreciated that cam 44 moves in synchronization with pump lever 47, the larger the rotation angle of cam 44, the greater the rotation angle of pump lever 47.

A switch 61 is provided for detecting the position of cam 44 as it rotates. Switch 61 comprises a rotatable switch lever 62 which slides on and is actuated by a cam surface 63 formed on the upper outer surface of cam 44 and serves as the second cam portion. Cam surface 63 comprises two arcuate surfaces 63A and 63B with a step 64 therebetween, the distance between arcuate surface 63B and cam shaft 43 being greater than the distance between arcuate surface 63A and cam shaft 43. When switch lever 62 is contacting cam surface 63B, switch 61 is "on", and when switch lever 62 comes in contact with cam surface 63A switch 61 is turned "off". Step 64 is located at a position which corresponds to the point at which roller 52 comes to the end of groove cam portion 53 closer to cam shaft 43. Switch 61 is connected to the control circuit of the stepping motor by means of lead wires 65, so that the stepping motor stops when switch 61 is turned "off".

Next, an explanation is given regarding the operation of the apparatus described above.

In order to prevent ink clogs from forming in the head nozzle, or alternatively, to rid the nozzle of ink clogs already formed in the nozzle, cap member 31 is moved by a driving means (not shown) to a position covering the head nozzle. Next, the stepping motor is operated to rotate drive shaft S by a predetermined number of steps, the rotary movement of the drive shaft being transmitted through the speed-reducing geartrain (not shown) and idle gear 42 to cam 44, which then rotates in the forward direction (the direction indicated as 44F in the drawing). With the rotation of cam 44, cam follower roller 52 of pump lever 47 revolves and at the same time slides in groove cam 53 of cam 44 in such a direction as to move away from cam shaft 43. This movement causes pump lever 47 to rotate around pin 46, in the forward direction (the direction indicated as 47F in the drawing). Pulled by said pump lever 47, movable member 27 of pump 23 moves in the direction indicated as 27F in the drawing, whereupon bellow 26 stretches, thereby increasing the interior volume of pump 23 and reducing the pressure therein. The negative pressure thus produced in pump 23 causes the ink to be sucked, together with the air, out of the head nozzle and through cap member 31, tube 30 and the opened check valve 35 into pump 23. At that time, the check valve 36, which is closed, prevents airflow from the outside through tube 33 into pump 23, and this makes the suction of the ink from the head nozzle possible.

Then, the stepping motor is operated in the reverse direction, and cam 44, driven by the stepping motor, rotates in the reverse direction (the direction indicated as 44R in the drawing). Therefore, pump lever 47 rotates in the reverse direction (the direction indicated as 47R in the drawing), and movable member 27 of pump moves also in the reverse direction (the direction indicated as 27R in the drawing), whereupon bellow 26 contracts, thereby reducing the interior volume of pump 23 and increasing the pressure therein. As a result, the ink and the air temporarily contained in the pump 23 is discharged out of pump 23 through the opened check valve 36 and tube 33. At that time, the check valve 35 which is closed, prevents air from flowing back from pump 23 towards cap member 31.

Cam 44 continues to rotate in the direction indicated as 44R until lever roller 52 reaches the end closer to cam shaft 43 of groove cam portion 53. Thus, when the contraction of bellow 26 reaches its limit, switch lever 62 which has been moving on cam surface 63B of cam 44, reaches step 64 and rotates in the clockwise direction, thereby turning off switch 61 and causing the stepping motor to stop at the same time. Note, while the stepping motor is running, switch lever 62 is rotated in the opposite direction and switch 61 is in the "on" position.

In the operation described above, the level of vacuum in the suction pump and, hence, the vacuum force applied to the printing nozzle is determined by the angle through which the stepper motor drive shaft has rotated. This angle, of course, is determined by the number of steps applied to the shaft by the stepper motor. According to a preferred embodiment of this invention, the operation of the stepper motor is controlled by a programmable motor controller 70. The later is programmed to normally apply a set number of steps to the stepper motor, such number being sufficient to draw a relatively low vacuum on the printing nozzle, a vacuum force of the type used in a start-up operation to condition the nozzle for a printing operation. In the event a greater vacuum force need be applied to the printing nozzle, e.g., to rid the nozzle of already-formed ink clogs, the controller responds to a signal produced by an operator-initiated prime switch 72 to substantially increase the number of steps applied to the stepping motor, e.g., by a factor 50–100%. In response to the increased number of steps of the stepping motor, lever 47 rotates farther in the counter-clockwise direction, causing bellows to expand further, and the vacuum pressure to increase. In other words, the greater the number of steps of the stepping motor, the larger the revolution and rotation angles of cam 44 and pump lever 47, and the greater the negative pressure produced in pump 23.

When replacing the print head, it is often desirable to prime the printing nozzles prior to the first printing operation. In such a case, a "new print head control" circuit 74 transmits a control signal to the motor controller 70 indicating the presence of a new print head. In response to this signal, controller 70 can be programmed to apply the nominal (low) vacuum force during two cycles of the shorter nominal movement of the pump lever 47. Obviously, any combination of pump cycles and stepper motor steps can be handled by the software of the computer portion of motor controller 70.

From the foregoing, it will be appreciated that the apparatus of the invention makes it possible to set various levels of negative pressure to be produced in the pump, thereby changing the ink-suction capability of the device, by means of simply changing the number of steps of the stepping motor, which serves as the driving source of the pump for sucking the ink. As it is thus possible to suck an appropriate amount of ink, without removing ink excessively for each case of preventing or removing ink clogs, waste of ink can be minimized. Moreover, it will be appreciated that the bellows-type pump described above is not susceptible to the "stiction" problems associated with piston/cylinder pumps in which dried residual ink in the vacuum chamber can impede the movement of the of the cylinder.

The invention has been described in detail with particular reference to preferred embodiments thereof, but it will be understood that variations and modifications can be effected within the spirit and scope of the invention.

What is claimed is:

1. An apparatus for inhibiting and removing ink clogs in a printing nozzle of an ink jet printer, said apparatus comprising:

a printing nozzle;

a vacuum source having at least first and second negative pressure levels; and means for selectively coupling said printing nozzle to said vacuum source to suck ink through said printing nozzle when said printing nozzle is not being used in a printing operation, the absolute value of said first negative pressure being adequate to suck ink through said printing nozzle to inhibit ink clogs from forming therein, the absolute value of said second negative pressure being greater than the absolute value of said first negative pressure and adequate to remove previously formed ink clogs from said printing nozzle.

2. The apparatus as defined by claim 1 wherein said vacuum source comprises:

means defining a vacuum chamber; and a movable member movable with respect to said vacuum chamber-defining means from a first position to a second position wherein the volume of said vacuum chamber is increased by a first amount to create said first negative pressure within said vacuum chamber, and from said first position to a third position wherein the volume of said vacuum chamber is increased by a second amount to create said second negative pressure within said vacuum chamber.

3. The apparatus as defined by claim 2 wherein said vacuum chamber-defining means comprises a flexible bellows, and said movable member is operatively coupled to said bellows to cause, during movement of said movable member, said bellows to expand or contract, depending on a direction of such movement, and thereby decrease or increase, respectively, the pressure within said vacuum chamber.

4. An apparatus for inhibiting and removing ink clogs in a printing nozzle of an ink jet printer, said apparatus comprising:

a printing nozzle;

a vacuum source having at least first and second negative pressure levels, said vacuum source including means defining a vacuum chamber and a movable member movable with respect to said vacuum chamber-defining means;

means for selectively coupling said printing nozzle to said vacuum source to suck ink through said printing nozzle when said printing nozzle is not being used in a printing operation, the absolute value of said first negative pressure being adequate to suck ink through said printing nozzle to inhibit ink clogs from forming therein, the absolute value of said second negative pressure being greater than the absolute value of said first negative pressure and adequate to remove previously formed ink clogs from said printing nozzle; and means for controlling the position of said movable member relative to said vacuum chamber-defining means to selectively provide said first negative pressure or said second negative pressure to said printing nozzle.

5. The apparatus as defined by claim 4 Wherein said control means comprises a stepper motor having a drive shaft operatively coupled to said movable member, an angular rotation of said shaft determining the position of said movable member.

6. The apparatus as defined by claim 4 wherein said vacuum chamber-defining means comprises a flexible bellows, and said movable member is operatively coupled to said bellows to cause, during movement of said movable member, said bellows to expand or contract, depending on a direction of such movement, and thereby decrease or increase, respectively, the pressure within said vacuum chamber.

7. The apparatus as defined by claim 4 wherein said movable member moves with respect to said vacuum chamber-defining means from a first position to a second position wherein the volume of said vacuum chamber is increased by a first amount to create said first negative pressure within said vacuum chamber, and from said first position to a third position wherein the volume of said vacuum chamber is increased by a second amount to create said second negative pressure within said vacuum chamber.

8. The apparatus as defined by claim 4 wherein said control means comprises:

a stepper motor having a rotatably-driven drive shaft operatively coupled to said movable member for adjusting the position of said movable member; and a programmable motor controller operatively coupled to said stepper motor for controlling the rotation of said drive shaft to selectively control the position of said movable member and thereby selectively provide at least two different levels of negative pressure to said printing nozzle.

* * * * *